US011305303B2

(12) United States Patent
Zhang et al.

(10) Patent No.: US 11,305,303 B2
(45) Date of Patent: Apr. 19, 2022

(54) WATER OUTLET ASSEMBLY AND SHOWER

(71) Applicant: Xiamen Solex High-Tech Industries Co., Ltd., Xiamen (CN)

(72) Inventors: Daqiang Zhang, Xiamen (CN); Chunjie Hong, Xiamen (CN); Wenxing Chen, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 122 days.

(21) Appl. No.: 16/859,986

(22) Filed: Apr. 27, 2020

(65) Prior Publication Data

US 2020/0338576 A1 Oct. 29, 2020

(30) Foreign Application Priority Data

Apr. 28, 2019 (CN) ..... 201910349666.0

(51) Int. Cl.
*B05B 3/04* (2006.01)
*B05B 1/16* (2006.01)

(52) U.S. Cl.
CPC ..... *B05B 3/0418* (2013.01); *B05B 1/16* (2013.01); *B05B 1/1681* (2013.01)

(58) Field of Classification Search
CPC ..... B05B 3/04; B05B 3/0418; B05B 1/3046; B05B 1/1636; B05B 1/16; B05B 1/1681
USPC ..... 239/381–383, 443, 446–449, 525, 530, 239/583, 586
See application file for complete search history.

(56) References Cited

U.S. PATENT DOCUMENTS 4,303,201 A * 12/1981 Elkins ..... B05B 1/1636 239/381
4,588,130 A * 5/1986 Trenary ..... B05B 1/1636 239/381
4,629,125 A * 12/1986 Liu ..... B05B 1/1636 239/383
5,201,468 A * 4/1993 Freier ..... B05B 1/1654 239/383
5,316,216 A * 5/1994 Cammack ..... B05B 1/1636 239/381

* cited by examiner

*Primary Examiner* — Steven J Ganey
(74) *Attorney, Agent, or Firm* — Cooper Legal Group, LLC

(57) ABSTRACT

The present disclosure discloses provides a water outlet assembly and a shower. The water outlet assembly comprises a body, an inclined water body, a rotation driving member, and a shutter. A first side of the body comprises a water inlet end, and a second side of the body comprises a plurality of water outlet holes. The inclined water body, the rotation driving member, and the shutter are disposed in the body. The inclined water body comprises one or more inclined water outlet holes. Water flows from the one or more inclined water outlet holes to the rotation driving member to drive the rotation driving member to rotate, and the rotation driving member drives the shutter to rotate. The shutter rotates to block some of the plurality of water outlet holes.

20 Claims, 20 Drawing Sheets

WATER OUTLET ASSEMBLY AND SHOWER

RELATED APPLICATIONS

This application claims priority to Chinese Patent Application 201910349666.0, filed on Apr. 28, 2019. Chinese Patent Application 201910349666.0 is incorporated herein by reference.

FIELD OF THE DISCLOSURE

The present disclosure relates to bathroom fixtures, and in particular relates to a water outlet assembly.

BACKGROUND OF THE DISCLOSURE

At present, in order to achieve dynamic splash water, a position of an outlet hole of a kitchen faucet for outputting aerated water generally deviates from a center position of a cover plate of the kitchen faucet to make space for movable parts. Therefore a water outlet position of the aerated water is at an eccentric position, and a visual appearance of the kitchen faucet becomes awkward. Moreover, the cover plate of the kitchen faucet coves a large area, a diameter of the cover plate is more than 50 mm, and an appearance of the cover is not beautiful.

BRIEF SUMMARY OF THE DISCLOSURE

The present disclosure resolves the aforementioned technical problem by providing a spiral water outlet assembly configured to generate spiral water to increase an impact force of flowing water.

In order to solve the aforementioned technical problems, the present disclosure provides a water outlet assembly. The water outlet assembly comprises a body, an inclined water body, a rotation driving member, and a shutter.

A first side of the body comprises a water inlet end, and a second side of the body comprises a plurality of water outlet holes. The inclined water body, the rotation driving member, and the shutter are disposed in the body. The inclined water body comprises one or more inclined water outlet holes.

Water flows from the one or more inclined water outlet holes to the rotation driving member to drive the rotation driving member to rotate, and the rotation driving member drives the shutter to rotate. The shutter rotates to block some of the plurality of water outlet holes.

In a preferred embodiment, the shutter and the rotation driving member are two independent components.

In a preferred embodiment, the rotation driving member comprises an impeller, and the impeller comprises blades disposed along a circumferential direction of the impeller at intervals. The impeller rotates to rub the shutter to drive the shutter to rotate.

In a preferred embodiment, the impeller is an eccentric impeller. A first side of the impeller facing the shutter extends outward to define a first convex portion extending toward the shutter, and the first convex portion is disposed in the shutter. When the impeller rotates, at least one of a side surface or an end surface of the first convex portion rubs the shutter.

In a preferred embodiment, a first side of the impeller facing the shutter extends outward to define a second convex portion extending toward the shutter. The second convex portion is a cam, and the cam is disposed in the shutter.

When the impeller rotates, at least one of a side surface or an end surface of the cam rubs the shutter.

In a preferred embodiment, the water outlet assembly further comprises a central rotation member. The impeller surrounds an outer side of the central rotation member, and a rotation shaft of the impeller is eccentrically disposed with respect to an axis of the central rotation member. The impeller rotates about the rotation shaft of the impeller and rotates about the axis of the central rotation member concurrently.

In a preferred embodiment, an inner circumference of the impeller comprises one of an internal gear and an external gear, and an outer circumference of the central rotation member comprises the other of the internal gear and the external gear. The internal gear and the external gear are engaged with each other.

In a preferred embodiment, the shutter comprises a rotation member driven by the rotation driving member, and an outer wall of the rotation member comprises one or more baffle boards along a circumferential direction of the rotation member.

In a preferred embodiment, the one or more inclined water outlet holes are disposed at intervals along a circumferential direction of the inclined water body. As the number of the one or more inclined water outlet holes decreases, a total water passing area of the one or more inclined water outlet holes decreases, and the rotation speed of the impeller increases.

In a preferred embodiment, a first end of each of the one or more inclined water outlet holes is connected to the water inlet end, and a second end of each of the one or more inclined water outlet holes is connected to the rotation driving member.

The present disclosure further provides a water outlet assembly. The water outlet assembly comprises a body, an inclined water body, a rotation driving member, a shutter, and a speed reducing member.

A first side of the body comprises a water inlet end, and a second side of the body comprises a plurality of water outlet holes. The inclined water body, the rotation driving member, and the shutter are disposed in the body. The inclined water body comprises one or more inclined water outlet holes. A first end of each of the one or more inclined water outlet holes is connected to the water inlet end, and a second end of each of the one or more inclined water outlet holes is connected to the rotation driving member.

Water flows from the one or more inclined water outlet holes to the rotation driving member to drive the rotation driving member to rotate, and the rotation driving member drives the shutter to rotate. The shutter rotates to vary which of the plurality of water outlet holes are blocked and which of the plurality of water outlet holes are open so as to enable the water to flow therethrough to form a spiral rhythmic water. The rotation driving member and the shutter surround an outer side the speed reducing member, and at least one of the rotation driving member or the shutter rotate to rub the speed reducing member to decelerate a speed of the rotation driving member.

In a preferred embodiment, the rotation driving member comprises an impeller, and the impeller comprises a plurality of blades disposed in a circumferential direction of the impeller at intervals. The shutter comprises one or more baffle boards connected between some of the plurality of blades.

In a preferred embodiment, the speed reducing member comprises a central rotation member. The impeller surrounds an outer side of the central rotation member, and a rotation shaft of the impeller is eccentrically disposed with respect to an axis of the central rotation member. The impeller rotates about the rotation shaft of the impeller and rotates about the axis of the central rotation member concurrently.

In a preferred embodiment, an inner circumference of the impeller comprises one of an internal gear and an external gear, and an outer circumference of the central rotation member comprises the other of the internal gear and the external gear. The internal gear and the external gear are engaged with each other.

The present disclosure further provides a shower, and the shower comprises a shower body. A front end of the shower body comprises the aforementioned water outlet assembly.

In a preferred embodiment, the body of the water outlet assembly further comprises a straight water outlet disposed at a shaft center of the body of the water outlet assembly, and the plurality of water outlet holes is disposed on a periphery of the straight water outlet. A center of the inclined water body comprises a first water outlet, and a center of the rotation driving member comprises a second water outlet. The water flows directly from the straight water outlet after passing through the first water outlet and the second water outlet.

In a preferred embodiment, an aerated water assembly is disposed on the straight water outlet.

In a preferred embodiment, the shower further comprises a switching assembly. The switching assembly comprises an operating member, a sealing element, and a spool. The spool comprises a first passage connected to a water outlet and a second passage connected to the one or more inclined water outlet holes. The operating member drives the sealing element to move to close the first passage or the second passage.

Compared with existing techniques, the technical solution of the present disclosure has the following advantages.

1. The present disclosure provides a water outlet assembly. The one or more baffle boards on the impeller block some of the plurality of water outlet holes, so that water can only flow out from the remaining water outlet holes of the water outlet assembly. Which of the water outlet holes are open varies as the impeller rotates to form dynamic spiral splash water-rhythmic water. Because water flows out from only some of the plurality of water outlet holes, an impact force of each of the remaining water outlet holes becomes stronger. Due to a dynamic effect of the water, a cleaning area of the rhythmic water does not decrease, and the rhythmic water has a characteristic of intermittent water outflow. Therefore, the rhythmic water has a vibration function and provides a better cleaning effect.

2. The present disclosure provides a water outlet assembly in which the impeller and the shutter are separately disposed, and the impeller is an eccentric impeller or a portion of the impeller extending into the shutter is a cam. Thereby, the impeller is always in contact with the shutter during a rotation of the impeller to generate a frictional force to drive the impeller to rotate.

3. The present disclosure provides a water outlet assembly. The water outlet assembly further comprises a central rotation member, and the impeller rotates about the central rotation member to achieve a revolution rotation during a self-rotation process of the impeller. Friction between the impeller and the central rotation member is configured to achieve a first deceleration, and friction between the impeller and the shutter is configured to achieve a second deceleration, therefore preventing the shutter from rotating too fast.

DETAILED DESCRIPTION OF THE EMBODIMENTS

Figure 1:
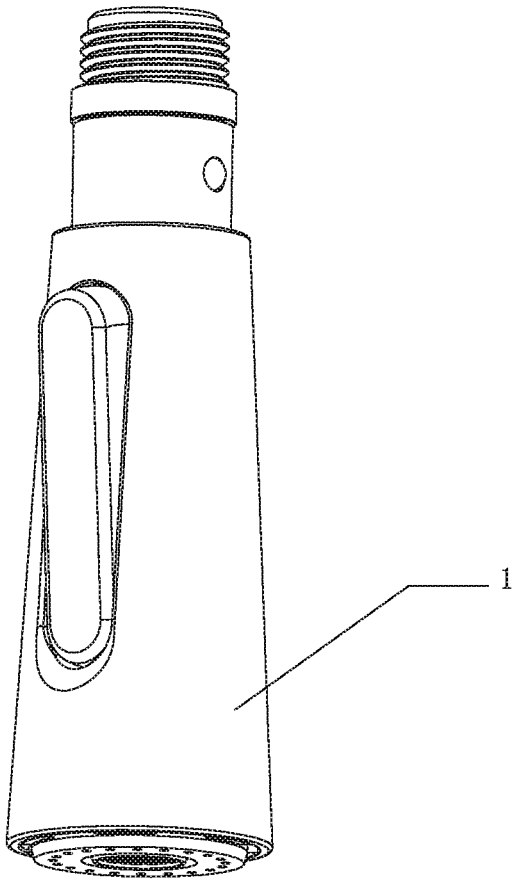
FIG. 1 illustrates a perspective view of a shower of Embodiment 1 of the present disclosure.
Figure 2:
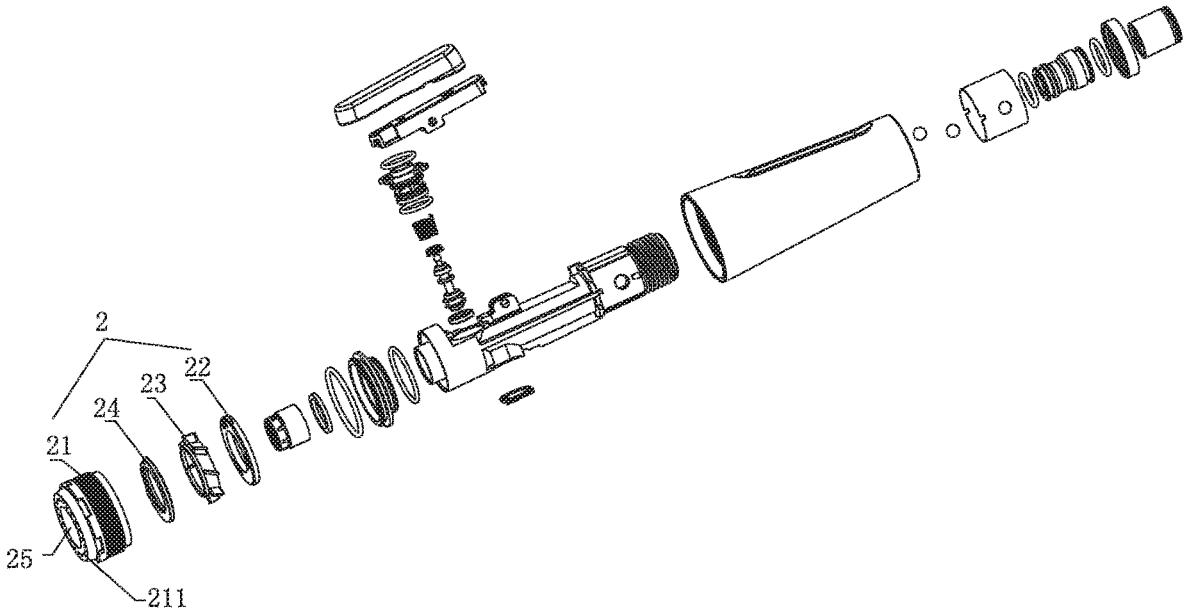
FIG. 2 illustrates an exploded perspective view of the shower of Embodiment 1 of the present disclosure.
Figure 3:
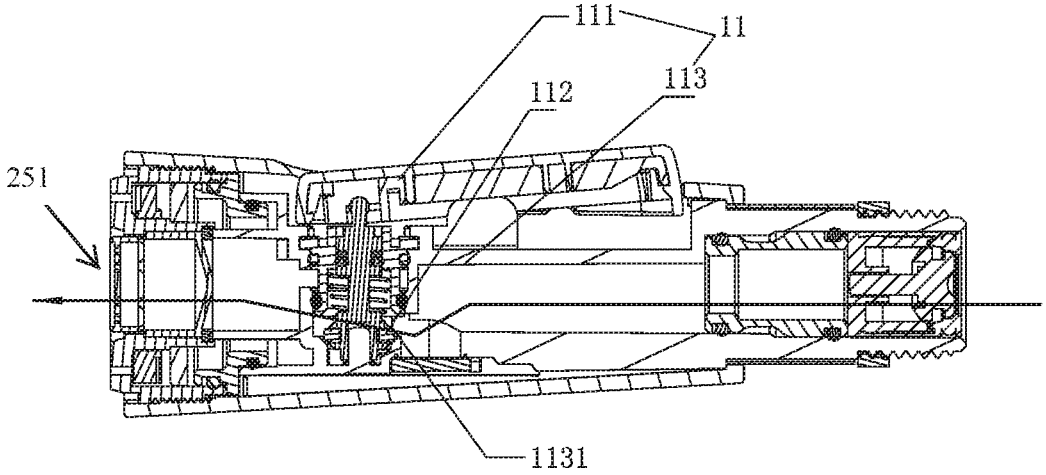
FIG. 3 illustrates a first waterway of the shower of Embodiment 1 of the present disclosure when aerated water flows out from the shower.
Figure 4:
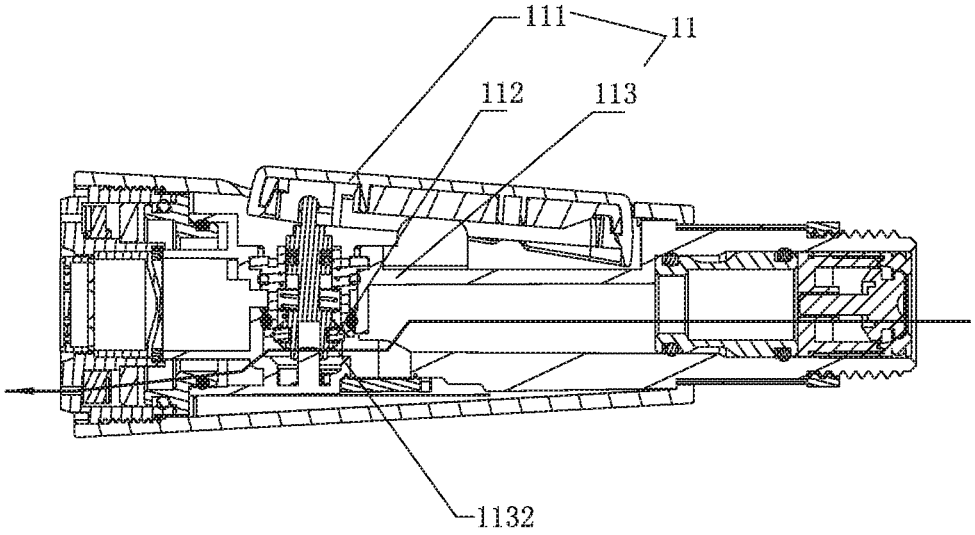
FIG. 4 illustrates a second waterway of the shower of Embodiment 1 of the present disclosure when rhythmic water flows out from the shower.
Figure 5:
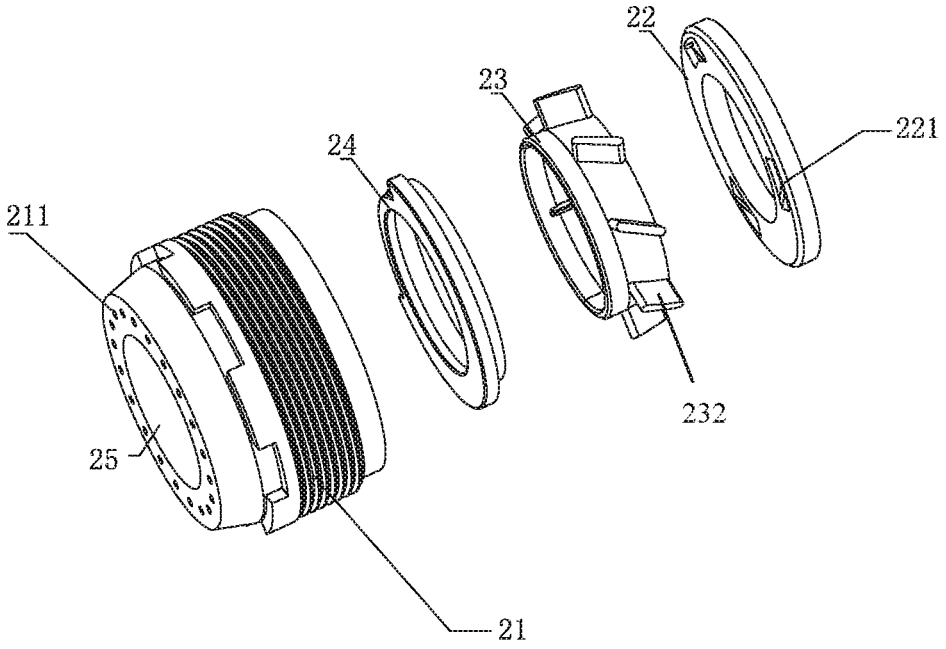
FIG. 5 illustrates an exploded view of an inclined water body, an impeller, and a shutter of Embodiment 1 of the present disclosure.
Figure 6:
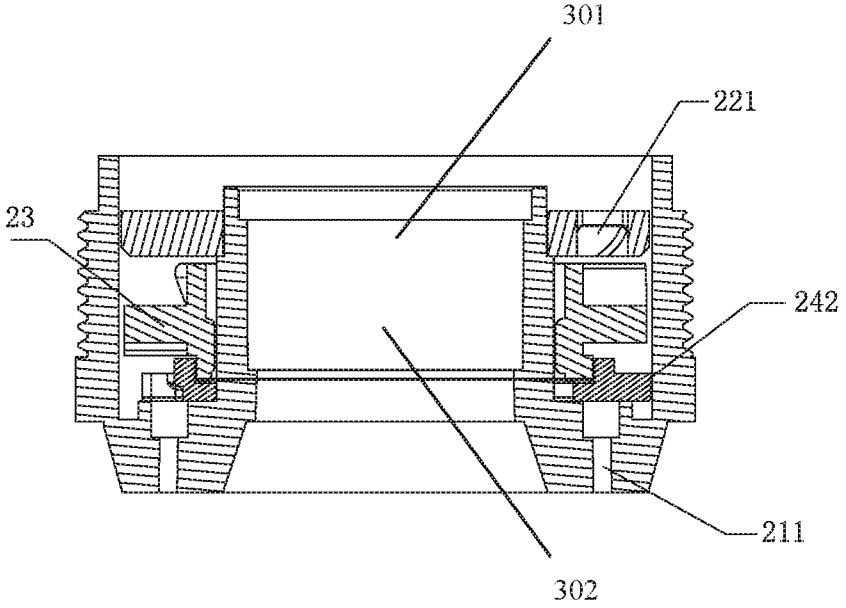
FIG. 6 illustrates a cross-sectional view of the inclined water body, the impeller, and the shutter of Embodiment 1 of the present disclosure when the inclined water body, the impeller, and the shutter are assembled.

The present disclosure will be further described below with the combination of the accompanying drawings together with the embodiments.

Embodiment 1

Referring to FIGS. 1-12, a shower comprises a shower body 1. A front end of the shower body 1 comprises a water outlet assembly 2.

The water outlet assembly 2 comprises: a body 21, an inclined water body 22, a rotation driving member 23, and a shutter 24;

A first side of the body 21 comprises a water inlet end, and a second side of the body 21 comprises a plurality of water outlet holes 211. The inclined water body 22, the rotation driving member 23, and the shutter 24 are disposed in the body 21. The inclined water body 22 comprises one or more inclined water outlet holes 221. A first end of each of the one or more inclined water outlet holes 221 is connected to the water inlet end, and a second end of each of the one or more inclined water outlet holes 221 is connected to the rotation driving member 23. Therefore, water flows from the one or more inclined water outlet holes 221 to the rotation driving member 23 to drive the rotation driving member 23 to rotate, and the rotation driving member 23 drives the shutter 24 to rotate synchronously. The shutter 24 varying which of the plurality of water outlet holes 211 are blocked during rotation of the shutter 24 and which of the plurality of water outlet holes 211 are open or in a water outflow state. By varying which of the plurality of water outlet holes 211 are opened and closed (i.e., blocked) when the shutter 24 rotates, a stepped spiral rhythmic water pattern is formed.

The shower comprises the water outlet assembly 2. The shutter 24 blocks some of the plurality of water outlet holes 211, so that the water always flows out from only a remaining portion of the plurality of water outlet holes 211 of the water outlet assembly 2 to define a water flowing portion. The water flowing portion always varies with a rotation of the shutter 24 to form dynamic spiral water-rhythmic water. Since water only flows out from some of the plurality of water outlet holes 211, an impact force of each of the plurality of water outlet holes 211 is stronger. Due to a dynamic effect of the water, a cleaning area of the rhythmic water does not decrease, and the rhythmic water has a characteristic of intermittent water outflow. Therefore, the rhythmic water has a vibration function and provides a better cleaning effect.

In the embodiment, the rotation driving member 23 is an impeller having blades 232 disposed along a circumferential direction of the impeller at intervals. The shutter 24 and the rotation driving member 23 are two independent components. The shutter 24 comprises a rotation member 241 driven by the rotation driving member 23, and an outer wall of the rotation member 241 comprises one or more baffle boards 242 along a circumferential direction of the rotation member 241.

In order to block the plurality of water outlet holes 211 by the one or more baffle boards 242, the plurality of water outlet holes 211 are arranged in a circle, and the one or more baffle boards 242 block a quarter of the plurality of water outlet holes 211. In one example, a length of the one or more baffle boards 242 can also be adjusted to enable the number of the plurality of water outlet holes 211 blocked by the one or more baffle boards 242 to change, which is a simple variation of the embodiment.

Figure 7:
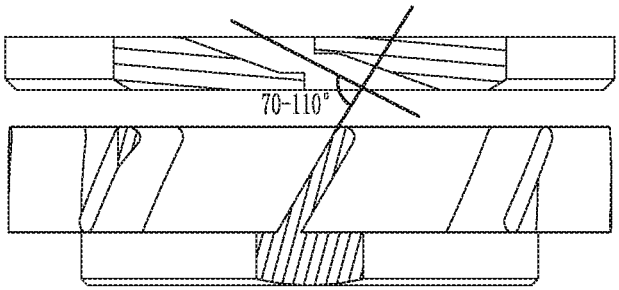
FIG. 7 illustrates a schematic view of the inclined water body and the impeller of Embodiment 1 of the present disclosure when the inclined water body and the impeller work together.

Further, the one or more inclined water outlet holes 221 and the blades 232 define an angle $\alpha$. The angle $\alpha$ is 70-110°. Therefore, a kinetic energy of the flowing water can be used to a maximum extent to drive the impeller to rotate, as shown in FIG. 7.

Finally, the one or more inclined water outlet holes 221 are disposed along a circumferential direction of the inclined water body 22 at intervals. A rotation speed of the impeller is a function of the number of the one or more inclined water outlet holes 221. As the number of the one or more inclined water outlet holes 221 decreases, a total water passing area of the one or more inclined water outlet holes 221 decreases, and the rotation speed of the impeller increases.

In the embodiment, in order to drive the rotation member 241 to rotate by the impeller, the impeller is an eccentric impeller. A lower end of the impeller deviates from a center position of the impeller by 0.5-3 mm, and an eccentric portion 233 of the eccentric impeller extends into the rotation member 241. At least one of a side surface or an end surface of the eccentric portion 233 rubs the rotation member 241. The water passing through the inclined water body 22 drives the impeller to rotate at a high speed. A rotation of the eccentric impeller enables the rotation member 241 to move to form a movement similar to a revolution rotation (in which an axis of rotation is not centered at a center axis of the rotation member 241), and a sliding friction generated between the eccentric impeller and the rotation member 241 drives the rotation member 241 to rotate to form a movement similar to a self-rotation (in which an axis of rotation is centered at the center axis of the rotation member 241). A relative rotation between the eccentric impeller and the rotation member 241 generates a speed difference, resulting in a deceleration effect and a reduced frequency of blocking the plurality of water outlet holes 211. Moreover, when the eccentric impeller rotates, the rotation member 241 is always in a moving state, a friction between the rotation member 241 and other coupling elements is a sliding friction, and a force of the friction is small. The structure of the eccentric impeller is configured to ensure that the eccentric impeller contacts the rotation member 241. The friction between the eccentric impeller and the rotation member 241 is continuous to ensure a continuous rotation of the rotation member 241.

Figure 8:
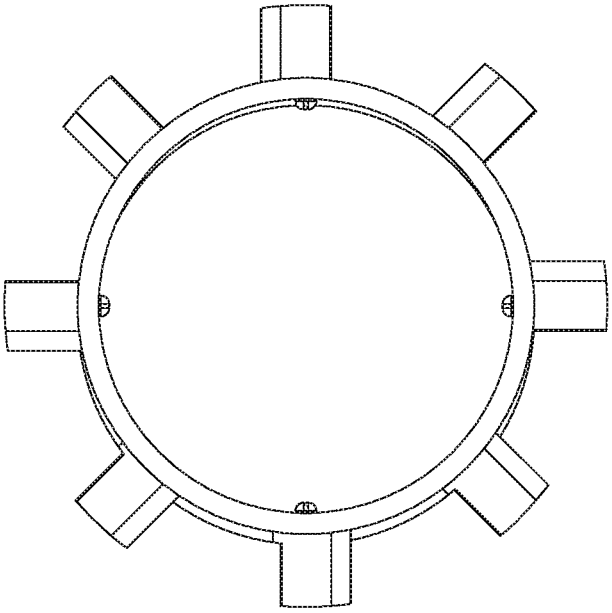
FIG. 8 illustrates a top view of the impeller of Embodiment 1 of the present disclosure.
Figure 9:
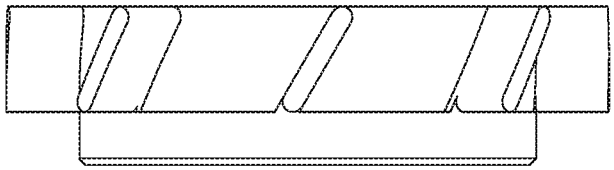
FIG. 9 illustrates a side view of the impeller of Embodiment 1 of the present disclosure.
Figure 10:
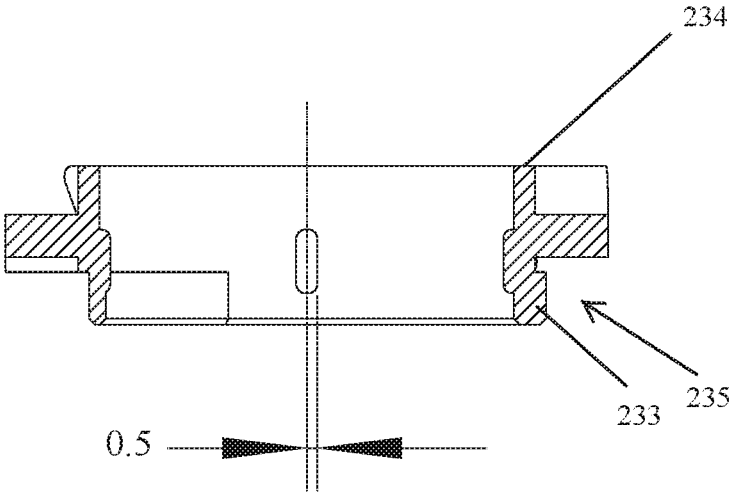
FIG. 10 illustrates a cross-sectional view of the impeller of Embodiment 1 of the present disclosure.
Figure 11:
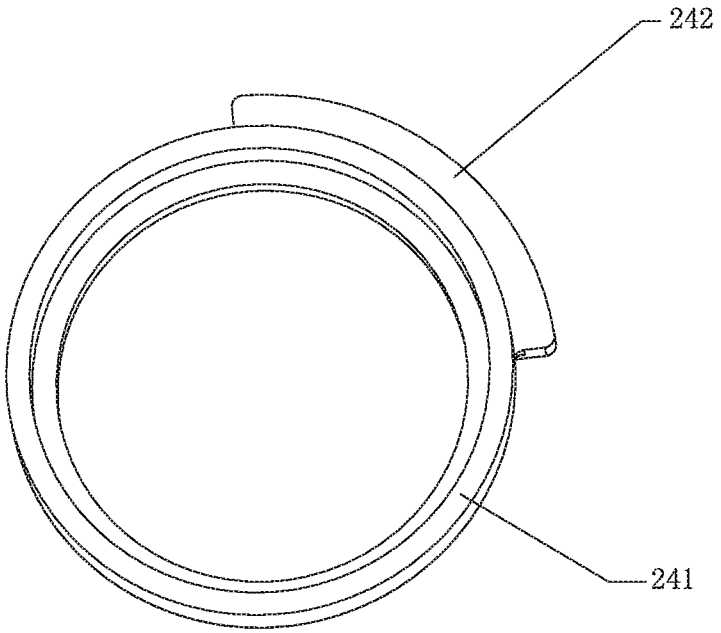
FIG. 11 illustrates a schematic view of the shutter of Embodiment 1 of the present disclosure.
Figure 12:
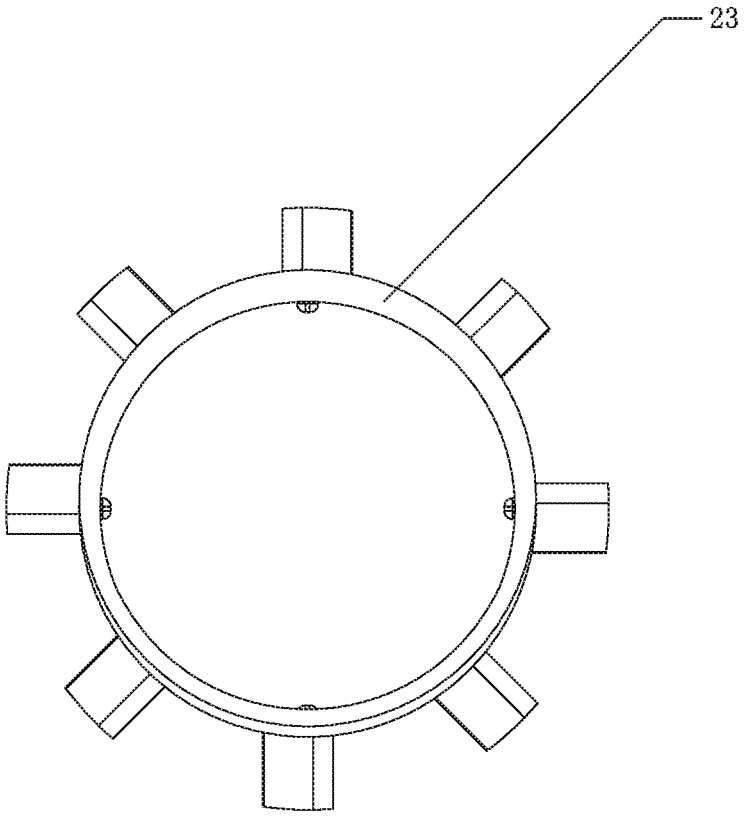
FIG. 12 illustrates a top view of the impeller of Embodiment 1 of the present disclosure.

Referring to FIGS. 8-10, an eccentric distance between a rotating surface 234 of the eccentric impeller and a first convex portion 235 (i.e., the eccentric portion 233) at the lower end of the eccentric impeller is 0.5 mm to achieve an eccentric rotation.

In order to further increase water spray patterns of the shower so as to enable the shower to have an aerated water effect in addition to having a rhythmic water effect, the body 21 of the water outlet assembly 2 also has a straight water outlet 25 disposed at a shaft center (i.e., an axial center) of the body 21. The plurality of water outlet holes 211 is disposed on a periphery of the straight water outlet 25, and the water directly flows out from the straight water outlet 25.

An aerated water assembly 251 is disposed on the straight water outlet 25 to achieve the aerated water effect. The straight water outlet 25 is disposed on the shaft center of the body 21, and the straight water outlet 25 is not eccentrically disposed to enable the appearance of the straight water outlet 25 to be more beautiful.

In order to switch between the rhythmic water and the aerated water, the body 21 further comprises a switching assembly 11 comprising an operating member 111, a seal 112, and a spool 113. The spool 113 comprises a first passage 1131 connected to water outlets 301 and 302 (i.e., a first water outlet 301 disposed on a center of the inclined water body 22 and a second water outlet 302 disposed on a center of the rotation driving member 23) and a second passage 1132 connected to the one or more inclined water outlet holes 221. The operating member 111 drives the seal 112 to move to close the first passage 1131 or the second passage 1132.

Embodiment 2

Figure 13:
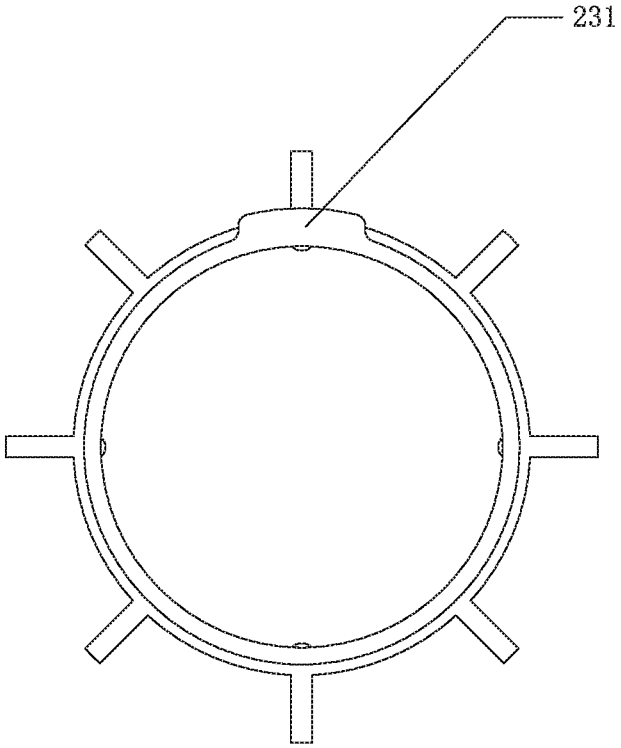
FIG. 13 illustrates a top view of an impeller of Embodiment 2 of the present disclosure.
Figure 14:
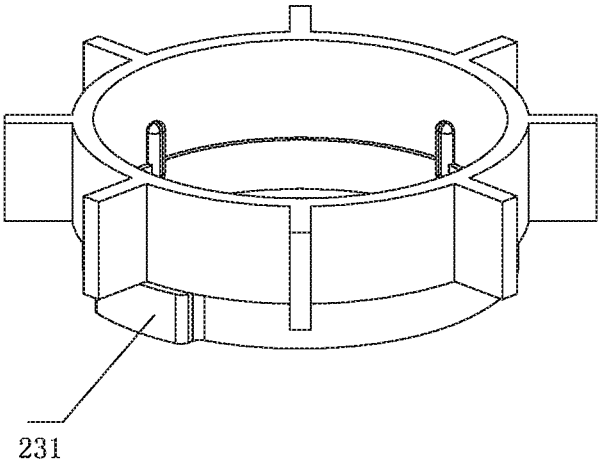
FIG. 14 illustrates a perspective view of the impeller of Embodiment 2 of the present disclosure.

Referring to FIGS. 13 and 14, a difference between this embodiment and Embodiment 1 is that the impeller is a normal impeller (for example, not an eccentric impeller), and a side of the impeller facing the shutter 24 extends toward the shutter 24 to define a second convex portion 231. The second convex portion 231 is a convex block defining a cam structure, and the convex block extends into the shutter 24. When the impeller rotates, at least one of a side surface or an end surface of the convex block rubs against the shutter 24.

Thus, although the impeller does not rotate eccentrically, a rotation of the convex block also drives the rotation member 241 to move to form a movement similar to a revolution rotation. A sliding friction generated between the cam structure and the rotation member 241 drives the rotation member 241 to rotate to form a movement similar to a self-rotation. The rest of Embodiment 2 is the same as Embodiment 1 and will not be described again. The second convex portion 231 can also be other various structures, besides a convex block, without departing from the spirit or scope of the present disclosure.

Embodiment 3

Figure 15:
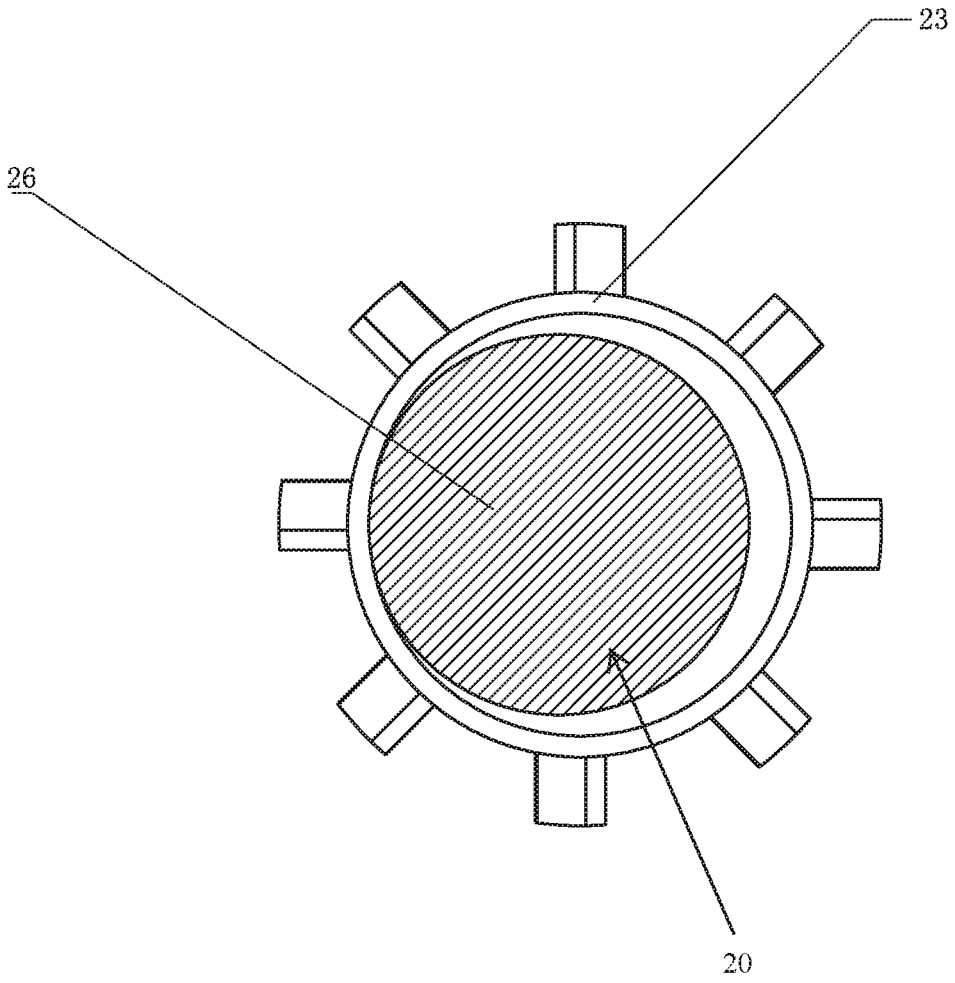
FIG. 15 is a schematic view of an impeller and a central rotation member of Embodiment 3 of the present disclosure when the impeller and the central rotation member are assembled.

Referring to FIG. 15, a difference between this embodiment and Embodiment 1 is that the impeller is a normal impeller (for example, not an eccentric impeller), the impeller surrounds an outer side of a speed reducing member 20, the speed reducing member 20 is a central rotation member 26, and a rotation shaft of the impeller is eccentrically disposed with respect to an axis of the central rotation member 26. The impeller rotates about its own rotation axis to define a self-rotation and rotates about an outer circumference of the central rotation member 26 to define a revolution rotation. The aforementioned structure is configured to achieve two-part deceleration. The impeller and the central rotation member 26 are configured to achieve a first deceleration, and a relative rotation between the impeller and the rotation member 241 is configured to achieve a second deceleration.

Embodiment 4

Figure 16:
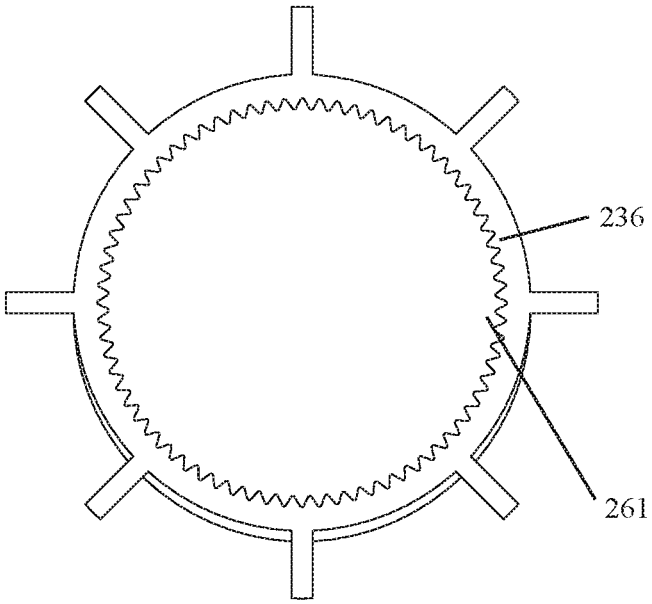
FIG. 16 illustrates a front view of an impeller of Embodiment 4 of the present disclosure.
Figure 17:
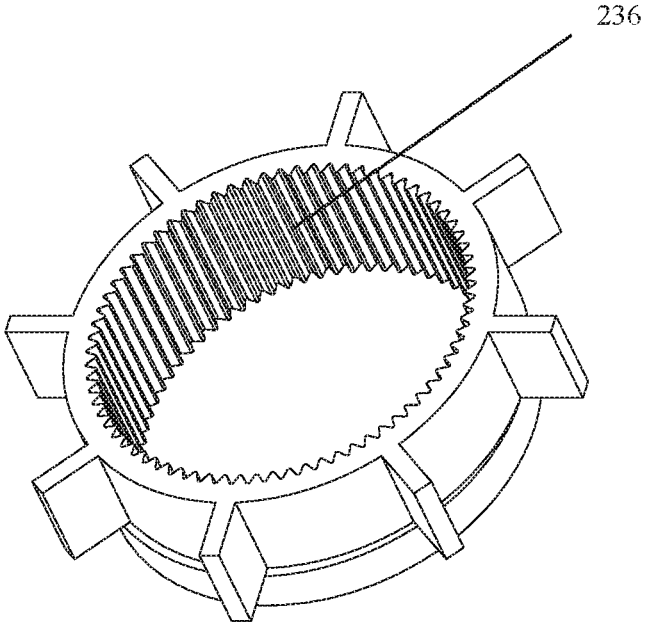
FIG. 17 illustrates a perspective view of the impeller of Embodiment 4 of the present disclosure.

Referring to FIGS. 16 and 17, this embodiment differs from Embodiment 3 in that an inner circumference of the impeller and the outer circumference of the central rotation member 26 respectively have an internal gear 236 and an external gear 261. The internal gear and the external gear are engaged with each other. A deceleration effect is further increased by the engagement of the internal gear and the external gear.

Embodiment 5

Figure 18:
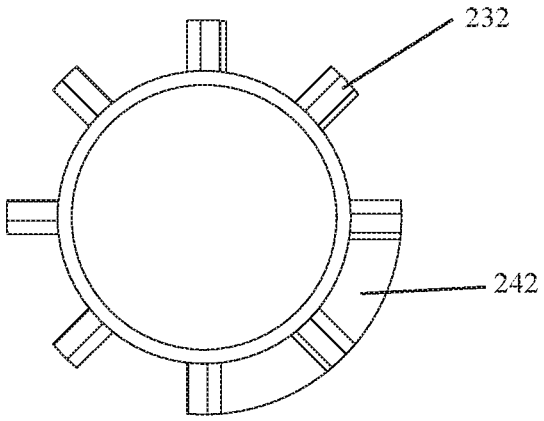
FIG. 18 illustrates a front view of an impeller of Embodiment 5 of the present disclosure.
Figure 19:
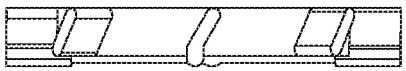
FIG. 19 illustrates a side view of the impeller of Embodiment 5 of the present disclosure.

Referring to FIGS. 18 and 19, this embodiment differs from Embodiment 1 in that the shutter 24 and the rotation driving member 23 are integrally designed. As an example structure, the rotation driving member 23 is an impeller, and the shutter 24 comprises one or more baffle boards 242 disposed between the blades 232. The one or more baffle boards 242 form an acute angle with the blades 232 so that the blades 232 of the impeller are inclined to reduce a heading resistance between the rotation of the impeller and the flowing water.

In order to achieve a deceleration effect, the impeller surrounds an outer side of a central rotation member 26, and a rotation shaft of the impeller is eccentrically disposed with respect to an axis of the central rotation member 26. The impeller rotates about its own rotation axis to define a self-rotation and rotates about an outer circumference of the central rotation member 26 to define a revolution rotation. The impeller and the central rotation member 26 are configured to achieve a deceleration.

Embodiment 6

Figure 20:
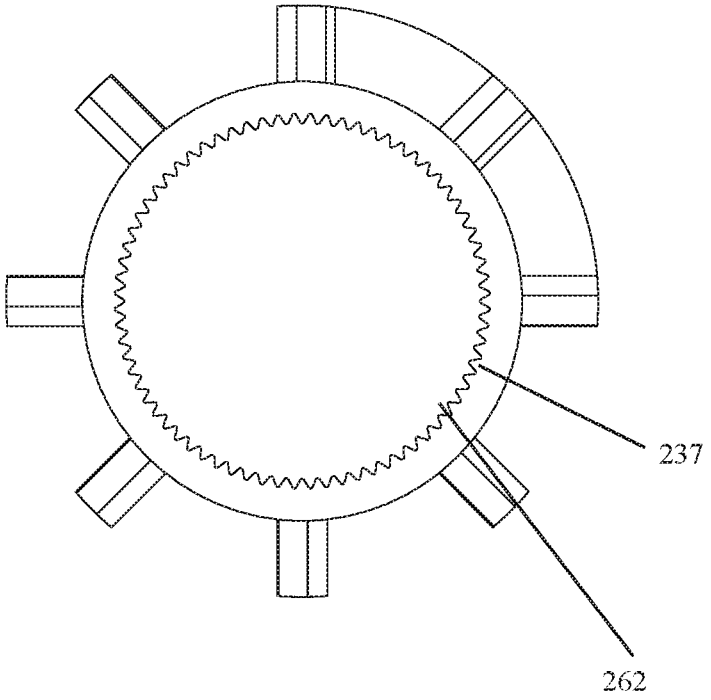
FIG. 20 illustrates a side view of an impeller of Embodiment 6 of the present disclosure.

Referring to FIG. 20, this embodiment differs from Embodiment 5 in that an inner circumference of the impeller and the outer circumference of the central rotation member 26 respectively have an internal gear 237 and an external gear 262. The internal gear and the external gear are engaged with each other. A deceleration effect is further increased by the engagement of the internal gear and the external gear.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A water outlet assembly, comprising:
a body,
an inclined water body,
a rotation driving member, and
a shutter, wherein:
the shutter and the rotation driving member are two independent components,
a first side of the body comprises a water inlet end,
a second side of the body comprises a plurality of water outlet holes,
the inclined water body, the rotation driving member, and the shutter are disposed in the body,
the inclined water body comprises one or more inclined water outlet holes,
water flows from the one or more inclined water outlet holes to the rotation driving member to drive the rotation driving member to rotate,
the rotation driving member drives the shutter to rotate, and
the shutter rotates to block some of the plurality of water outlet holes.

2. The water outlet assembly according to claim 1, wherein:
the rotation driving member comprises an impeller,
the impeller comprises blades disposed along a circumferential direction of the impeller at intervals, and
the impeller rotates to rub the shutter to drive the shutter to rotate.

3. The water outlet assembly according to claim 2, wherein:
the impeller is an eccentric impeller,
a first side of the impeller facing the shutter extends outward to define a first convex portion extending toward the shutter,
the first convex portion is disposed in the shutter, and
when the impeller rotates, at least one of a side surface or an end surface of the first convex portion rubs the shutter.

4. The water outlet assembly according to claim 2, wherein:
a first side of the impeller facing the shutter extends outward to define a second convex portion extending toward the shutter,
the second convex portion is a cam,
the cam is disposed in the shutter, and when the impeller rotates, at least one of a side surface or an end surface of the cam rubs the shutter.

5. The water outlet assembly according to claim 2, further comprising:

a central rotation member, wherein:

the impeller surrounds an outer side of the central rotation member, a rotation shaft of the impeller is eccentrically disposed with respect to an axis of the central rotation member, and the impeller rotates about the rotation shaft of the impeller and rotates about the axis of the central rotation member concurrently.

6. The water outlet assembly according to claim 5, wherein:

an inner circumference of the impeller comprises one of an internal gear and an external gear, an outer circumference of the central rotation member comprises the other of the internal gear and the external gear, and the internal gear and the external gear are engaged with each other.

7. The water outlet assembly according to claim 1, wherein:

the shutter comprises a rotation member driven by the rotation driving member, and an outer wall of the rotation member comprises one or more baffle boards along a circumferential direction of the rotation member.

8. The water outlet assembly according to claim 7, wherein:

the one or more inclined water outlet holes are disposed at intervals along a circumferential direction of the inclined water body.

9. A shower, comprising:

a shower body, wherein:

a front end of the shower body comprises the water outlet assembly according to claim 1.

10. The shower according to claim 9, wherein:

the body of the water outlet assembly further comprises a straight water outlet disposed at a shaft center of the body of the water outlet assembly, the plurality of water outlet holes is disposed on a periphery of the straight water outlet, a center of the inclined water body comprises a first water outlet, a center of the rotation driving member comprises a second water outlet, and the water flows directly from the straight water outlet after passing through the first water outlet and the second water outlet.

11. The shower according to claim 10, wherein an aerated water assembly is disposed on the straight water outlet.

12. The shower according to claim 9, wherein:

the shower further comprises a switching assembly, the switching assembly comprises an operating member, a sealing element, and a spool, the spool comprises a first passage connected to a water outlet and a second passage connected to the one or more inclined water outlet holes, and the operating member drives the sealing element to move to close the first passage or the second passage.

13. A water outlet assembly, comprising:

a body, an inclined water body, a rotation driving member, a shutter, and a speed reducing member, wherein:

a first side of the body comprises a water inlet end, a second side of the body comprises a plurality of water outlet holes, the inclined water body, the rotation driving member, and the shutter are disposed in the body, the inclined water body comprises one or more inclined water outlet holes, a first end of each of the one or more inclined water outlet holes is connected to the water inlet end, a second end of each of the one or more inclined water outlet holes is connected to the rotation driving member, water flows from the one or more inclined water outlet holes to the rotation driving member to drive the rotation driving member to rotate, the rotation driving member drives the shutter to rotate, the shutter rotates to vary which of the plurality of water outlet holes are blocked and which of the plurality of water outlet holes are open so as to enable the water to flow therethrough to form a spiral rhythmic water, the rotation driving member and the shutter surround an outer side the speed reducing member, and at least one of the rotation driving member or the shutter rotate to rub the speed reducing member to decelerate a speed of the rotation driving member.

14. The water outlet assembly according to claim 13, wherein:

the rotation driving member comprises an impeller, the impeller comprises a plurality of blades disposed along a circumferential direction of the impeller at intervals, and the shutter comprises one or more baffle boards connected between some of the plurality of blades.

15. The water outlet assembly according to claim 14, wherein:

the speed reducing member comprises a central rotation member, the impeller surrounds an outer side of the central rotation member, a rotation shaft of the impeller is eccentrically disposed with respect to an axis of the central rotation member, and the impeller rotates about the rotation shaft of the impeller and rotates about the axis of the central rotation member concurrently.

16. The water outlet assembly according to claim 15, wherein:

an inner circumference of the impeller comprises one of an internal gear and an external gear, an outer circumference of the central rotation member comprises the other of the internal gear and the external gear, and the internal gear and the external gear are engaged with each other.

17. A water outlet assembly, comprising:

a body, an inclined water body, a rotation driving member, and a shutter, wherein:

the shutter comprises a rotation member driven by the rotation driving member, an outer wall of the rotation member comprises one or more baffle boards along a circumferential direction of the rotation member, a first side of the body comprises a water inlet end, a second side of the body comprises a plurality of water outlet holes, the inclined water body, the rotation driving member, and the shutter are disposed in the body, the inclined water body comprises one or more inclined water outlet holes, water flows from the one or more inclined water outlet holes to the rotation driving member to drive the rotation driving member to rotate, the rotation driving member drives the shutter to rotate, and the shutter rotates to block some of the plurality of water outlet holes.

18. The water outlet assembly according to claim 17, wherein:

the one or more inclined water outlet holes are disposed at intervals along a circumferential direction of the inclined water body.

19. A shower, comprising:

a shower body, wherein:

a front end of the shower body comprises the water outlet assembly according to claim 17.

20. The shower according to claim 19, wherein:

the body of the water outlet assembly further comprises a straight water outlet disposed at a shaft center of the body of the water outlet assembly, the plurality of water outlet holes is disposed on a periphery of the straight water outlet, a center of the inclined water body comprises a first water outlet, a center of the rotation driving member comprises a second water outlet, and the water flows directly from the straight water outlet after passing through the first water outlet and the second water outlet.

* * * * *